US011851971B2

(12) United States Patent
Cheng et al.

(10) Patent No.: US 11,851,971 B2
(45) Date of Patent: Dec. 26, 2023

(54) SYSTEM AND METHOD FOR HANGER AND PACKOFF LOCK RING ACTUATION

(71) Applicant: Baker Hughes Oilfield Operations LLC, Houston, TX (US)

(72) Inventors: Samuel Cheng, Houston, TX (US); Prashant Patel, Tomball, TX (US); Xichang Zhang, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 118 days.

(21) Appl. No.: 17/514,270

(22) Filed: Oct. 29, 2021

(65) Prior Publication Data

US 2023/0132558 A1 May 4, 2023

(51) Int. Cl.
*E21B 33/04* (2006.01)
*E21B 23/03* (2006.01)

(52) U.S. Cl.
CPC ..... *E21B 33/04* (2013.01); *E21B 23/03* (2013.01)

(58) Field of Classification Search
CPC ..... E21B 33/04; E21B 33/03
See application file for complete search history.

(56) References Cited

U.S. PATENT DOCUMENTS 5,129,660 A * 7/1992 Taylor ..... E21B 33/04 277/553
5,174,376 A * 12/1992 Singeetham ..... E21B 33/043 166/182
8,936,092 B2 1/2015 Nguyen
9,074,448 B2 7/2015 Gette
9,151,134 B2 10/2015 Reimert
10,233,713 B2 3/2019 Minnock
10,669,792 B2 6/2020 Nguyen
2013/0146306 A1 6/2013 Yates
2016/0245040 A1 * 8/2016 Nelson ..... E21B 33/038
2017/0159399 A1 6/2017 Sommerfeld
2021/0062603 A1 3/2021 Cheng

FOREIGN PATENT DOCUMENTS

GB 2251013 6/1992
GB 2537959 11/2016
WO 2018/052566 3/2018

OTHER PUBLICATIONS

"SS-15 Bigbore II Subsea Wellhead Systems," 2018, Dril-Quip, https://www.dril-quip.com/ss15bbii-subsea-wellhead.html, 5 pages.
International Search Report and Written Opinion dated Mar. 7, 2023 in corresponding PCT Application No. PCT/US2022/078574.

* cited by examiner

*Primary Examiner* — Giovanna Wright
(74) *Attorney, Agent, or Firm* — HOGAN LOVELLS US LLP

(57) ABSTRACT

A wellbore system includes a hanger lock energizing ring, a hanger lock ring, and a shoulder ring. The wellbore system further includes a seal energizing ring coupled to the shoulder ring. The wellbore system also includes a seal element being driven into an energized position by the seal energizing ring. The wellbore system further includes a seal lock energizing ring being driven to move via one or more extensions. The wellbore system includes a seal lock ring being supported, at least in part, by the seal energizing ring. Both the hanger lock ring and the seal lock ring are set, substantially simultaneously, responsive to movement of the one or more extensions.

20 Claims, 10 Drawing Sheets

SYSTEM AND METHOD FOR HANGER AND PACKOFF LOCK RING ACTUATION

BACKGROUND

1. Field of the Disclosure

The present disclosure relates to wellbore operations. Specifically, the present disclosure relates to systems and methods for engagement of wellbore components, such as metal-to-metal annulus packoffs and hangers.

2. Description of Related Art

Oil and gas operations may be conducted in a variety of operations, such as subsea or surface environments, where components are installed on a rig or sea floor. Systems used in oil and gas operations may be heavy, experience extreme temperature or pressure scenarios, and be challenging to move between locations. As a result, reducing the number of components utilized or reducing the number of "runs" or "trips" within a wellbore is desirable. Certain operations may use a series of tubulars that are positioned coaxially within a wellbore, where inner tubulars are "hung" or otherwise suspended from outer tubulars. Normally, these tubulars are separately installed and secured into position, which may increase a number of runs, and thereby, increase costs associated with the wellbore. Similar drawbacks are also present during removal of the components.

SUMMARY

Applicants recognized the problems noted above herein and conceived and developed embodiments of systems and methods, according to the present disclosure, for wellbore operations.

In an embodiment, a wellbore system includes a hanger lock energizing ring, a hanger lock ring, and a shoulder ring, wherein the shoulder ring supports at least a portion of the hanger lock ring on a shoulder. The wellbore system further includes a seal energizing ring coupled to the shoulder ring, the seal energizing ring being positioned axially lower than the shoulder. The wellbore system also includes a seal element associated with the seal energizing ring, the seal element being driven into an energized position by the seal energizing ring. The wellbore system further includes a seal lock energizing ring arranged axially lower than the shoulder ring, the seal lock energizing ring being driven to move via one or more extensions coupled to the seal lock energizing ring. The wellbore system includes a seal lock ring positioned axially lower than the shoulder ring, the seal lock ring being supported, at least in part, by the seal energizing ring. Both the hanger lock ring and the seal lock ring are set, substantially simultaneously, responsive to movement of the one or more extensions.

In another embodiment, a method includes landing at least a portion of a seal assembly on a hanger. The method also includes applying a first uphole force to a shoulder ring, the shoulder ring transferring at least a portion of the first uphole force to an upper seal energizing ring to drive the upper seal energizing ring in a downhole direction. The method further includes energizing an upper seal of a seal element via the upper seal energizing ring. The method includes energizing a lower seal of the seal element via a lower seal energizing ring. The method also includes applying a second uphole force to set a hanger lock energizing ring and a seal lock energizing ring.

In an embodiment, a seal assembly includes a seal element having an upper seal and a lower seal, the seal element being driven into an energized position via engagement of the upper seal and the lower seal by an upper seal energizing ring and a lower seal energizing ring. The seal assembly further includes a shoulder ring coupled to the upper seal energizing ring, the shoulder ring to transmit a downward force to at least the upper seal energizing ring to drive the upper seal energizing ring in a downward direction after at least a portion of the seal assembly is landed on a hanger. The seal assembly also includes a hanger lock ring positioned on a shoulder of the shoulder ring, the hanger lock ring being driven in a radially outward direction and into a wellhead housing responsive to movement in the downward direction by a hanger lock energizing ring. The seal assembly further includes a seal lock energizing ring coupled to the hanger lock energizing ring, the seal lock energizing ring being set simultaneously with the hanger lock ring.

In an embodiment, a wellbore system includes a hanger lock energizing ring, a hanger lock ring, and a shoulder ring, wherein the shoulder ring supports at least a portion of the hanger lock ring on a secondary shoulder and the hanger lock energizing ring coupled to one or more extensions. The wellbore system also includes a seal energizing ring coupled to the shoulder ring, the seal energizing ring being positioned axially lower than the secondary shoulder. The wellbore system further includes a seal element associated with the seal energizing ring, the seal element being driven into an energized position by the seal energizing ring. The wellbore system also includes a seal lock energizing ring arranged axially lower than the shoulder ring, the seal lock energizing ring being driven to move via the one or more extensions coupled to the seal lock energizing ring and the hanger lock energizing ring. The wellbore system further includes a seal lock ring positioned axially lower than the shoulder ring, the seal lock ring being supported, at least in part, by the seal energizing ring. Both the hanger lock ring and the seal lock ring are set, substantially simultaneously, responsive to movement of the one or more extensions.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1:
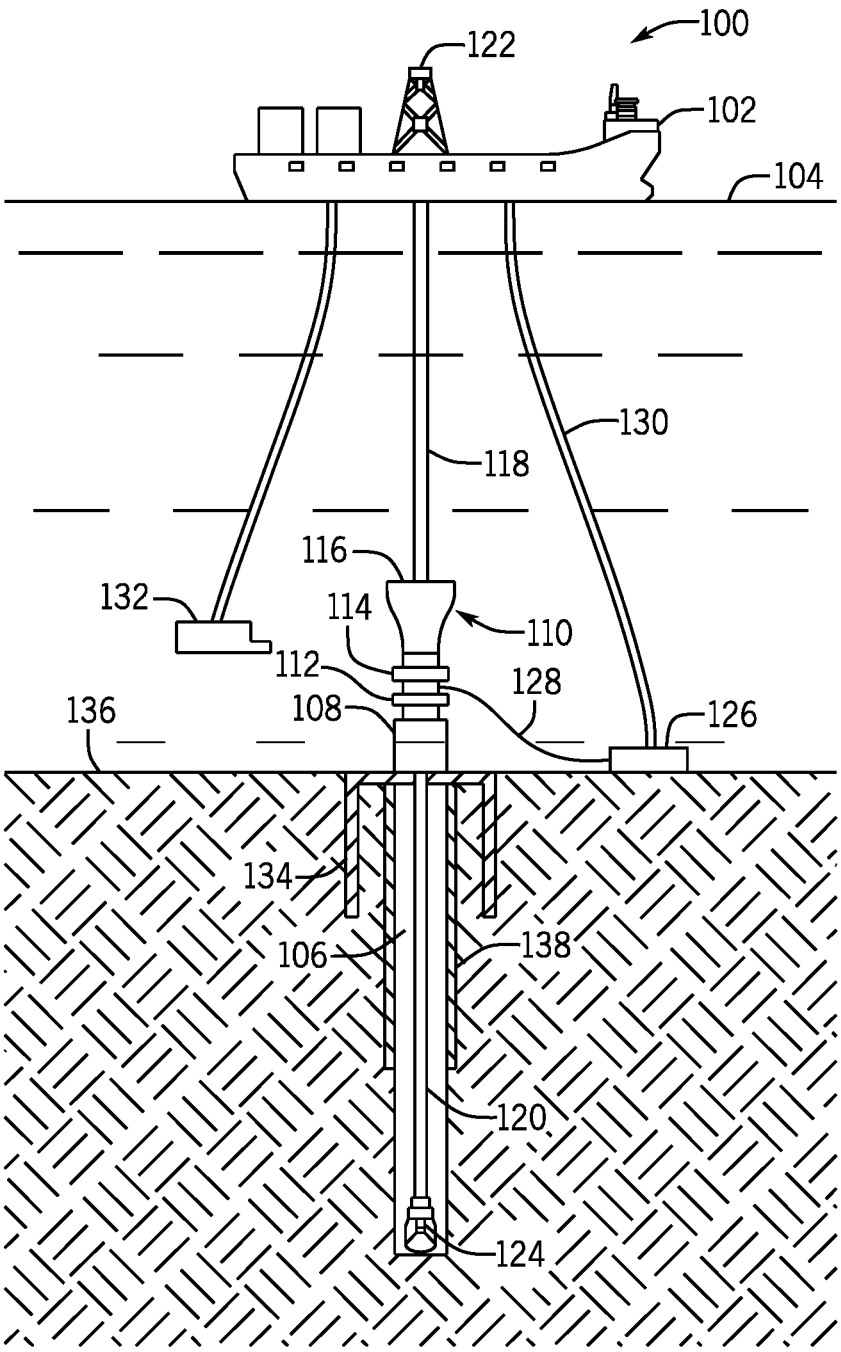
FIG. 1 is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should be further appreciated that terms such as approximately or substantially may indicate +/−10 percent.

Embodiments of the present disclosure are directed toward systems and method for simultaneous or near-simultaneous actuation for engagement of an inner annulus packoff lock ring with a casing/tubing hanger and an outer hanger lock ring with a wellhead housing. In at least one embodiment, both upper and lower lock rings are actuated into engagement with a corresponding groove using one or more solid actuators, which may be coupled using load members which extend through a lock down carrier. Various embodiments simplify operational tooling and allow one or more seals to be locked down from above (e.g., from an uphole position), which improves debris tolerance and installation reliability.

Various embodiments are directed toward simultaneous or near-simultaneous locking of packoff and hanger lock rings in one stroke via one or more solid actuation rings for actuating and backing up the lock ring. In at least one embodiment, a pair of solid actuation rings are used (e.g., at top and bottom locations). In at least one embodiment, a lock down carrier serves as a primary load transferring body that allows a tool to set a seal. The tool applies a force to this body that sets the seal directly. In various embodiments, the lock down carrier houses one or more load transfer members, which may be an arrangement of bolts or extensions, that are contained in a series of corresponding holes that are formed through the lock down carrier body. These bolts or extensions may be threaded into a seal lock actuation ring (e.g., a solid ring seal lock actuation sleeve) that sets a seal lock down ring. In certain embodiments, the upper section of the shoulder bolts are housed and secured in a series of holes in the hanger lock actuation ring. In at least one embodiment, once the seal is set, a second function of the tool drives the hanger lock actuation sleeve down to drive the hanger lock ring out and into engagement with a wellhead housing. At the same time or substantially the same time, the shoulder bolts are driven down through the lock ring carrier. Because the seal lock actuation sleeve is fastened to the ends of these shoulder bolts, the seal lock ring is driven into engagement with the hanger neck. In at least one embodiment, the lock down carrier has a secondary load shoulder that allows the hanger lock down force to be transferred through the lock down carrier, into the hanger lock ring, and directly into the housing without going through the seal elements. The secondary load shoulder is thereby not the primary hanger neck shoulder and does not take any or a significant portion of the subsequent hanger weight from a hanger landed above or pressure end load from a test plug or other equipment that may land above the hanger. It should be appreciated that a variety of configurations may be utilized for the respective load shoulders in order to distribute forces within the wellbore. By way of example only, the secondary load shoulder may be arranged at an angle sloping downwards and away from a bore axis and, in contrast, the primary load shoulder may be arranged at an angle sloping downwards toward the bore axis.

Various embodiments overcome present challenges of locking a seal to hanger body at the same or substantially the same time as locking the hanger to the wellhead. As a result, embodiments may reduce a number of trips into the wellbore, thereby decreasing costs, among other benefits. In at least one embodiment, embodiments enable the annulus packoff to be set through the lockdown carrier directly, which may enable the lock rings to be energized on a separate tool function. Accordingly, the setting forces to set the seal are applied directly to the seal and not through a selective mechanism, like a shear ring. In this manner, the seal can be set directly through the lock down carrier and the lock rings are set with a separate tool function at substantially the same time.

FIG. 1 is a side schematic view of an embodiment of a subsea drilling operation 100. It should be appreciated that one or more features have been removed for clarity with the present discussion and that removal or inclusion of certain features is not intended to be limited, but provided by way of example only. Furthermore, while the illustrated embodiment describes a subsea drilling operation, it should be appreciated that one or more similar processes may be utilized for surface applications and, in various embodiments, similar arrangements or substantially similar arrangements described herein may also be used in surface applications. The drilling operation includes a vessel 102 floating on a sea surface 104 substantially above a wellbore 106. A wellhead housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 108 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation. It should be appreciated that this describes one example of a portion of a subsea drilling operation and may be omitted in various embodiments. In at least one embodiment, systems and methods of the present disclosure may be used for drilling operations that are completed through a BOP and wellhead, where a casing hanger and string are landed in succession.

Figure 2:
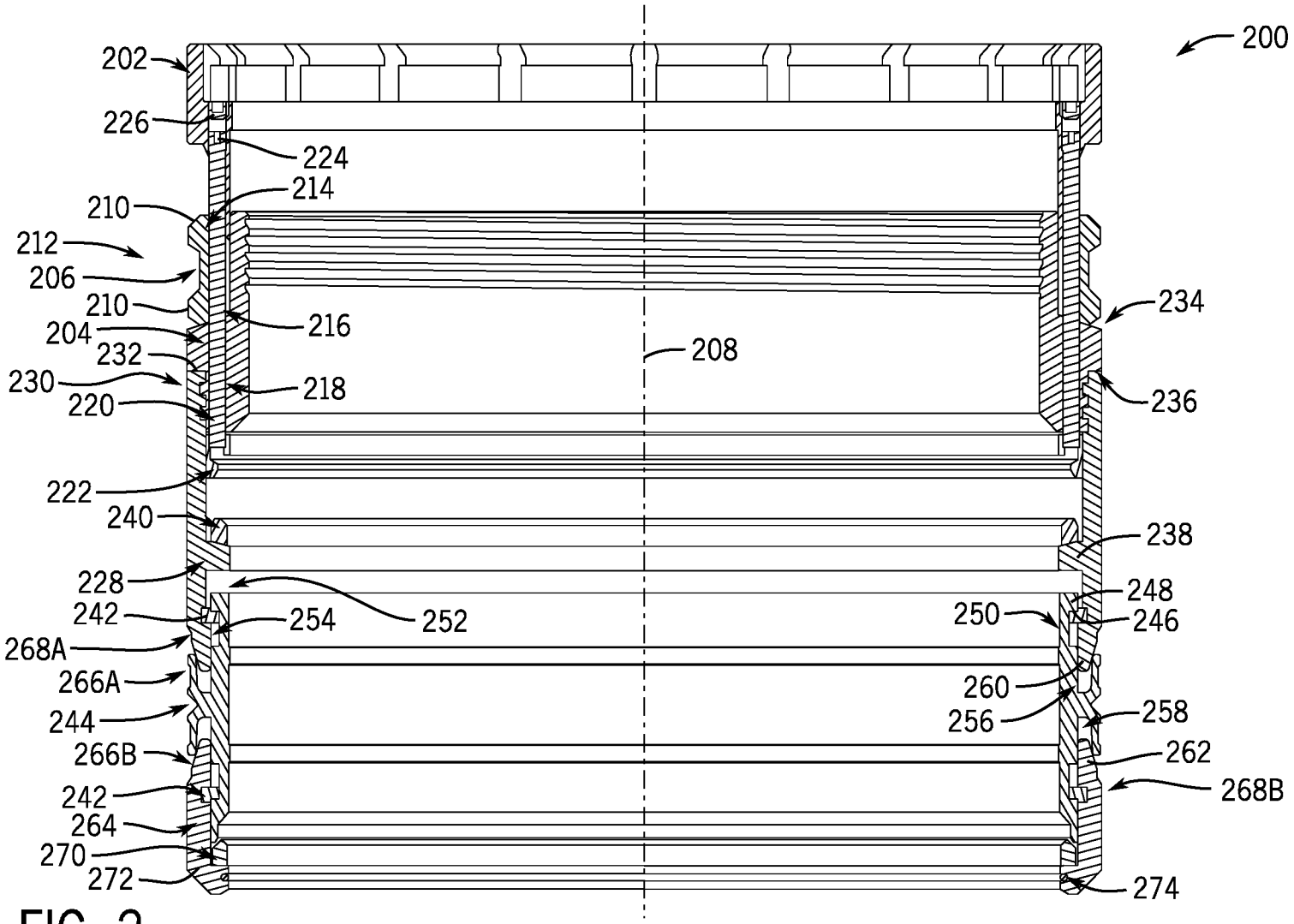
FIG. 2 is a cross-sectional view of an embodiment of a seal assembly, in accordance with embodiments of the present disclosure.

FIG. 2 is a cross-sectional side view of an embodiment of a sealing system 200 (e.g., seal assembly). In at least one embodiment, the sealing system 200 may include one or more components associated with a hanger, a wellhead, and the like. It should be appreciated that the system 200 may include more or fewer components, and certain components have been eliminated for simplicity with the following discussion. In this example, a hanger lock energizing ring (E-ring) 202 is axially aligned with a shoulder ring 204 such that at least a portion of the hanger lock E-ring 202 overlaps at least a portion of the shoulder ring 204. For example, at least part of an upper portion of the shoulder ring 204 may be overlapped by the hanger lock E-ring 202. As such, at least part of an outer diameter of the shoulder ring 204 is smaller than at least part of an inner diameter of the hanger lock E-ring 202.

In at least one embodiment, a hanger lock ring 206 is positioned circumferentially with respect to the shoulder ring 204 such that at least a portion of the hanger lock ring 206 is radially outward of at least a portion of the shoulder ring 204, with respect to an assembly axis 208. In operation, the assembly axis 208 is parallel to a wellbore axis, but it should be appreciated that certain components may bend or otherwise be positioned at an angle such that the assembly axis 208 is not always in a straight vertical position as shown in FIG. 2. The hanger lock ring 206 includes locking elements 210 that extend radially outward to form, at least in part, a lock ring recess 212 that may, in combination, form a hanger lock ring profile 214. As will be described below, in various embodiments the hanger lock ring 206 may be driven in a radially outward direction, with respect to the assembly axis 208, such that the hanger lock ring profile 214 engages a mating hanger profile.

Various embodiments include a hanger rock ring passage 216 and a shoulder ring passage 218 that enables an extension 220, which is shown here as a shoulder bolt, to extend toward and couple to a seal lock energizing ring (E-ring) 222. For example, in the illustrated configuration the extension 220 is coupled to a lip 224 of the hanger lock E-ring 202 and movement with respect to the lip may be blocked, for example via one or more fasteners 226, such as a set screw. That is, a gap between the fasteners 226 and the extension 220 may enable predetermined movement or sliding of the extension 220, but movement beyond a certain degree would be blocked by the fasteners 226. The extension 220 is then positioned within the respective passages 216, 218 and coupled to the seal lock E-ring 222, for example via one or more mating connections, such as threads. It should be appreciated that various embodiments may include different extension configurations, such as a solid or semi-solid piece, a piece that includes a circumferential span, or the like. Moreover, in at least one embodiment, different configurations may be provided for coupling the illustrated components together, such as one or more overlapping regions between the extension 220 and the hanger lock E-ring 202, among other options. In at least one embodiment, a back face of the lock ring 206 includes one or more relief slots, which may be spaced circumferentially. These relief slots may have varying widths and be positioned to accommodate the extensions 220. Accordingly, as the lock ring 206 expands, the relief slots enable expansion around the extensions 220 without interference.

In this example, the extension 220 extends from the hanger lock E-ring 202 and axially beyond an end of the shoulder ring 204. That is, an end of the extension 220 is axially lower than an end of the shoulder ring 204. It should be appreciated that, in various embodiments, the extension 220 may vary in length. Moreover, there may be multiple extensions where some extend at different lengths than others. As will be described in detail below, movement of the hanger lock E-ring 202 in an axially downward direction along the assembly axis 208 is transmitted to the extension 220, which further drives the seal lock E-ring 222 in an axially downward direction. This movement will facilitate energizing both the lock rings simultaneously.

An upper seal E-ring 228 may be coupled to the shoulder ring 204, for example using one or more fastening mechanisms 230 such as threads, fasteners, or the like. In various embodiments, the upper seal E-ring 228 is arranged below a shoulder 232 of the shoulder ring 204, where the shoulder 232 is an extension that projects radially outward with respect to a body portion of the shoulder ring 204. As illustrated, the shoulder 232 includes an uphole side 234 (e.g., a top side, an axially higher side) and a downhole side 236 (e.g., a bottom side, an axially lower side) where the hanger lock ring 206 is positioned on the uphole side 234 and the upper seal E-ring 228 is positioned to abut the downhole side 236. It should be appreciated that while contact between the upper seal E-ring 228 and shoulder 232 is shown in FIG. 2, other embodiments may include a gap or intermediate component between the upper seal E-ring 228 and the shoulder 232.

In the illustrated embodiment, the seal lock E-ring 222 is arranged circumferentially within the upper seal E-ring 228 in that at least portions of the upper seal E-ring 228 is positioned radially outward of the seal lock E-ring 222, with respect to the assembly axis 208. In at least one embodiment, a seal lock E-ring 222 position within the upper seal E-ring 228 is based, at least in part, on dimensions of one or more of the hanger lock E-ring 202, the shoulder ring 204, and/or the extension 220. By way of example only, a longer (e.g., axially longer) shoulder ring 204 may change a position of the seal lock E-ring 222 with respect to the upper seal E-ring 228.

Further illustrated is a shelf 238 extending radially inward from a body of the upper seal E-ring 228. The illustrated shelf 238 is positioned axially lower than the seal lock E-ring 222 and is further separated from the fastening mechanism 230. In various embodiments, a radial extent of the shelf 238 may be based, at least in part, on one or more additional component within the system, such as one or more tubulars or the illustrated seal lock ring 240. For example, as shown in FIG. 2, the seal lock ring 240 may be positioned on the shelf 238 such that axial movement in a downward (e.g., downhole) direction is blocked by the shelf 238. It should be appreciated that, in various embodiments, one or more dimensions of the shelf 238 and/or the seal lock ring 240 may be particularly selected such than an inner diameter at the shelf 238 is substantially equal to an inner diameter with respect to the seal lock ring 240. As will be described below, in operation movement of the hanger lock E-ring 202 in a downward direction may also drive movement of the seal lock E-ring 222 in a downward direction, and once in a selected position, the seal lock ring 240 may be utilized to secure the seal lock E-ring 222 into position.

Continuing with the upper seal E-ring 228, a groove is illustrated to receive one or more retainer segments 242. The retainer segments 242 are positioned within the groove and extend radially inward, with respect to the assembly axis 208, and may be utilized to position or otherwise retain a seal element 244, which as described below may include both an upper seal and a lower seal. The illustrated retainer segments 242 may include a span (not shown) of a certain circumferential extent. That is, the retainer segments 242 may correspond to a plurality of segments 242, where segments 242 may have equal or different circumferential extends. As will be described, segments 242 may be installed through one or more apertures formed within upper seal E-ring 228. The retainer segments 242 support the seal element 244 along an edge 246 that contacts an overhang 248 of the seal element 244. Accordingly, at least a portion of the retainer segments 242 are radially overlapped by the seal element 244. It should be appreciated that, in at least one embodiment, one or more fasteners may be utilized to secure the seal element 244 to the upper seal E-ring 228 and/or to the retainer segments 242. Furthermore, it should be appreciated that the retainer segments 242 may act as a passive restraint with respect to the seal element 244 such that the retainer segments 242 block movement of the seal element 244 in a downward (e.g., downhole) direction but permit movement in an upward (e.g., uphole) direction. Additionally, it should be appreciated that the movement between the seal element 244 and the retainer segments 242 may be driven by movement of the upper seal E-ring 228, rather than movement of the seal element 244. However, one or both of the components may move axially with respect to one another. In this example, the retainer segments 242 extend into a notch 250 formed, at least in part, by a reduced outer diameter portion axially below the overhang 248.

In at least one embodiment, a space 252 is present between the shelf 238 and the overhang 248. In at least one embodiment, the space 252 is substantially equivalent in length to a gap 254 between the retainer segments 242 and a bottom of the notch 250. In operation, the space 252 and the gap 254 may, at least in part, restrict or otherwise define a movement length of one or more of the upper seal E-ring 228 and/or the seal element 244. By way of example, the upper seal E-ring 228 may be driven in an axially downward direction such that a bottom of the shelf contacts the overhang 248 and/or such that the retainer segments 242 are moved to a bottom of the notch 250. Such movement may serve to activate the seal element 244.

The illustrated seal element 244 includes an upper opening 256 and a lower opening 258, where the upper opening 256 receives an end 260 of the upper seal E-ring 222 and the lower opening 258 receives an end 262 of a lower seal E-ring 264. In this example, the respective ends 260, 262 are shaped to have respective variable diameters such that a first end diameter 266A, 266B is smaller than a second end diameter 268A, 268B. Accordingly, as the respective ends 260, 262 are driven further into their associated openings 256, 258 the seal element 244 undergoes greater expansion to form the seal with the housing (not pictured) on the seal OD side. It should be appreciated that a seal is also formed on the seal ID side. By way of example, the ID side seals are energized by the interference between the seal element 244 and a hanger neck (not pictured). In at least one embodiment, movement of the seal element 244 past the straight hanger seal pocket forms the ID seal.

In a configuration that substantially mirrors at least a portion of the upper seal E-ring 222, the lower seal E-ring 264 is associated with one or more retainer segments 242 that include respective edges 246 that interact with overhangs 248. In contrast to the configuration described above, the position of the respective space 252 and gap 254 associated with the lower seal E-ring 264 may move in an axially upward direction and/or the seal element 244 may move an in axially downward direction, thereby reducing lengths of the spaces 252 and/or gap 254 as the lower seal E-ring 264 is driven into the lower opening 258.

Further illustrated is a retainer ring 270 that is positioned axially lower, at least in part, than the seal element 244 and is positioned against a lower shoulder 272 of the lower seal E-ring 264. In at least one embodiment, the retainer ring 270 is utilized to lock the lower seal E-ring 264 into place, for example by moving into a groove or slot formed within a hanger, among other options. In operation, the retainer ring 270 may further be deenergized to allow removal of the seal system 200, for example retainer ring 270 may maintain a position of the lower seal E-ring 264 to prevent dragging the seal element 244 in an energized position during removal.

Embodiments of the present disclosure may also include a wiper o-ring 274, which in this example is positioned axially below (e.g., downhole) of the retainer ring 270 and is positioned within a groove formed within at least a portion of the lower shoulder 272. The wiper o-ring may be utilized to clean one or more surfaces, such as an outer diameter of a hanger neck, among other options.

As will be described below, various embodiments of the present disclosure may be utilized to set and retrieve the seal system 200 where one or more components are set and/or energized substantially simultaneously. By way of example, in a seal setting sequence, one or more portions of the seal assembly 200 may be landed on a hanger shoulder. For example, a back side of the lower shoulder 272 may be landed on a hanger shoulder, where the hanger is positioned within a wellbore that may, in certain embodiments, include a wellhead housing radially outward from and co-axial with the hanger. A running tool may be utilized to apply a force from an uphole direction (e.g., a downward force), where the force is applied to the shoulder ring 204, either directly or via connections with one or more components, such that the force is transmitted to the upper seal E-ring 228, which drives the end 260 into the upper opening 256. As a portion of the seal element 244 is energized, load may continue to be applied until the lower seal E-ring 264 is driven into the lower opening 258. Such a force will energize the seal element 244 and also engage the retainer ring 270, for example within an opening or groove of the hanger. As force continues to be applied and/or a second force function on the tool is applied, the extensions 220 may be driven in a downward direction against the seal lock E-ring 222, where the downward movement of the attached hanger lock E-ring 202 may drive the hanger lock ring 206 into mating grooves of the housing, while also activating the seal lock E-ring 222 and the seal lock ring 240. In this manner, both the seal and hanger lock rings may be simultaneously or substantially simultaneously be energized. It should be appreciated that the order in which the upper and lower seals are set may be reversed such that the upper seal (e.g., the seal associated with the upper opening 256) is set second and the lower seal (e.g., the seal associated with the lower opening 258) is set first. Furthermore, in embodiments, both seals may be set simultaneously or substantially simultaneously. In at least one embodiments, the seals are set based on a friction balance between different sliding parts, and as a result, the ordering may vary based on one or more operational factors.

Various embodiments may further be drawn toward a seal retrieval sequence. In at least one embodiment, one or more retrieval faces may be utilized, where a tool may couple to at least one of the hanger lock ring E-ring 202 and/or the shoulder ring 204. It should be appreciated that other retrieval interfaces may also be utilized in various embodiments. A force may be applied in an upward direction (e.g., an uphole force, a force toward a surface location, etc.) to disengage both lock rings 206, 240. As the shoulder ring 204 is moved in an upward direction, the upper seal of the seal element 244 (e.g., the seal associated with the upper opening 256) is unenergized due to the movement of the end 260. However, due to the location of the retainer ring 270, the lower seal E-ring 264 associated with the lower seal (e.g., the seal associated with the lower opening 258) may be maintained at the landed elevation. As the upper seal E-ring 228 is moved in an upward direction, the retainer segments 242 may contact the associated overhang 248, which may lead to deenergizing the lower seal and deenergizing the retainer ring 270. As a result, the assembly 200 may then be removed after the seal element 244 is deenergized.

Figure 3:
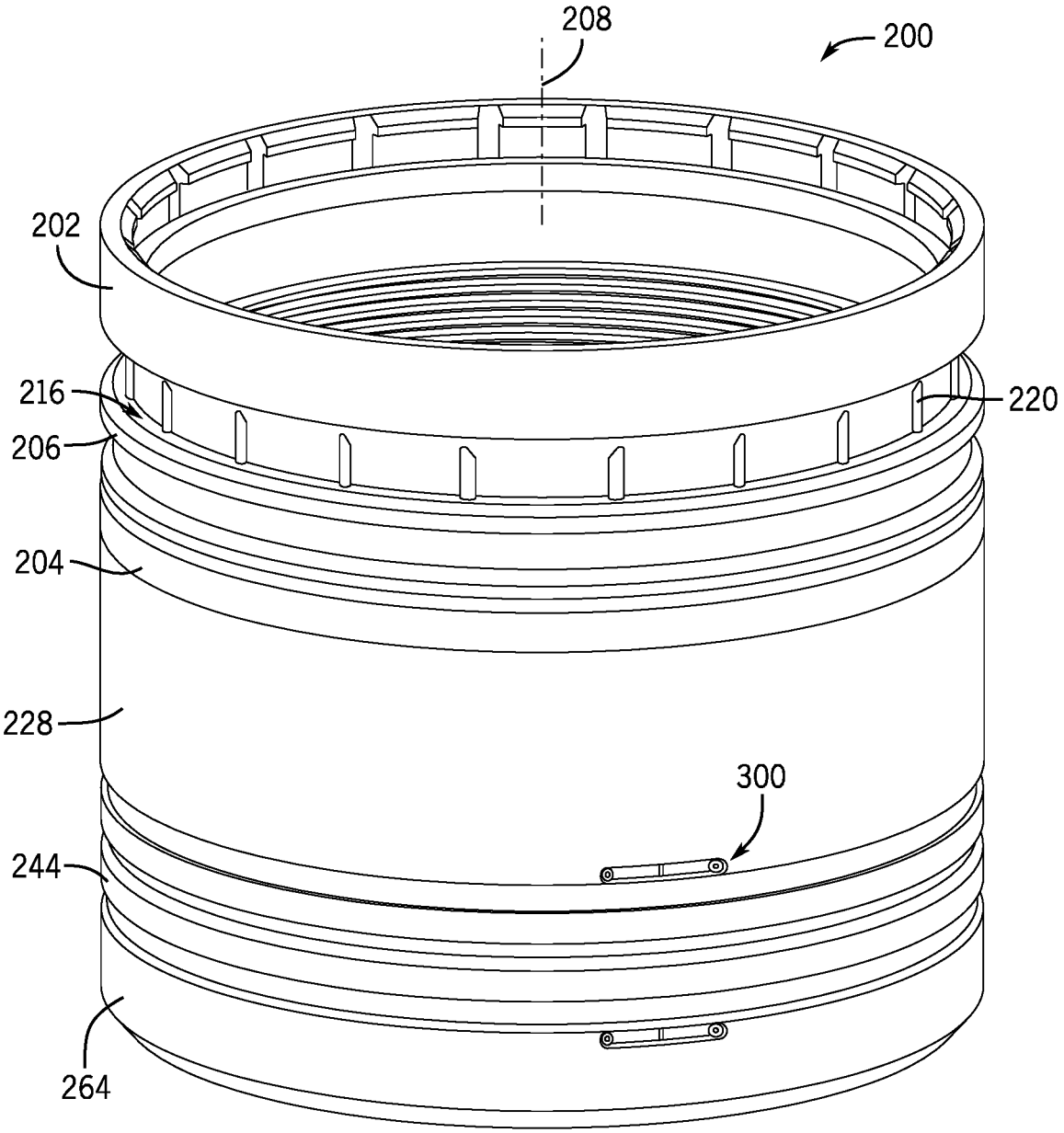
FIG. 3 is a perspective view of an embodiment of a seal assembly, in accordance with embodiments of the present disclosure.

FIG. 3 is a perspective view of an embodiment of the seal system 200. In at least one embodiment, the seal system 200 includes one or more annular components, such as the illustrated hanger lock E-ring 202, hanger lock ring 206, shoulder ring 204, upper seal E-ring 228, lower seal E-ring 264, and seal element 244, among other components. It should be appreciated that various components have variable outer diameter portions, as shown in FIG. 3, and that different dimensions may be particularly selected based on expected operating conditions, such as wellbore diameter, other associated components, and the like.

In this example, the extensions 220 are illustrated as individual components that are circumferentially positioned about the assembly axis 208. For example, the extensions 220 may correspond to bolts or shoulder bolts that extend through the lock ring passage 216 and the shoulder ring passage 218 to couple to the seal lock E-ring 222. In various embodiments, there are more or fewer extensions 220 than the number illustrated in FIG. 3, and it should be appreciated that a number of extensions 220 may be particularly selected based, at least in part, on one or more design conditions. Furthermore, it should be appreciated that the extensions 220 may not be individual bolts or components, but may be a single annular component. Additionally, in one or more embodiments, each of the extensions 220 may not have an equal circumferential extent and may, instead, have different sizes at different locations about the assembly axis 208. That is, each of the extensions 220 may not be similarly sized.

As shown in FIG. 3, each of the upper seal E-ring 228 and the lower seal E-ring 264 include respective passages 300 to receive retainer segments 242. The passages 300 may enable a retainer segment 242 to be installed within an outer diameter of the respective E-rings 228, 264, be pushed or rotated circumferentially, and then have another retainer segment 242 be installed. Retainer segments 242 may be installed until an entire inner circumference is filled with retainer segments 242. In various embodiments, there are multiple passages 300 and passages 300 may have different circumferential lengths, based, at least in part, on dimensions of the retainer segments 242. In certain embodiments, one or more fasteners may be utilized to secure one or more retainer segments 242 into position.

Figure 4:
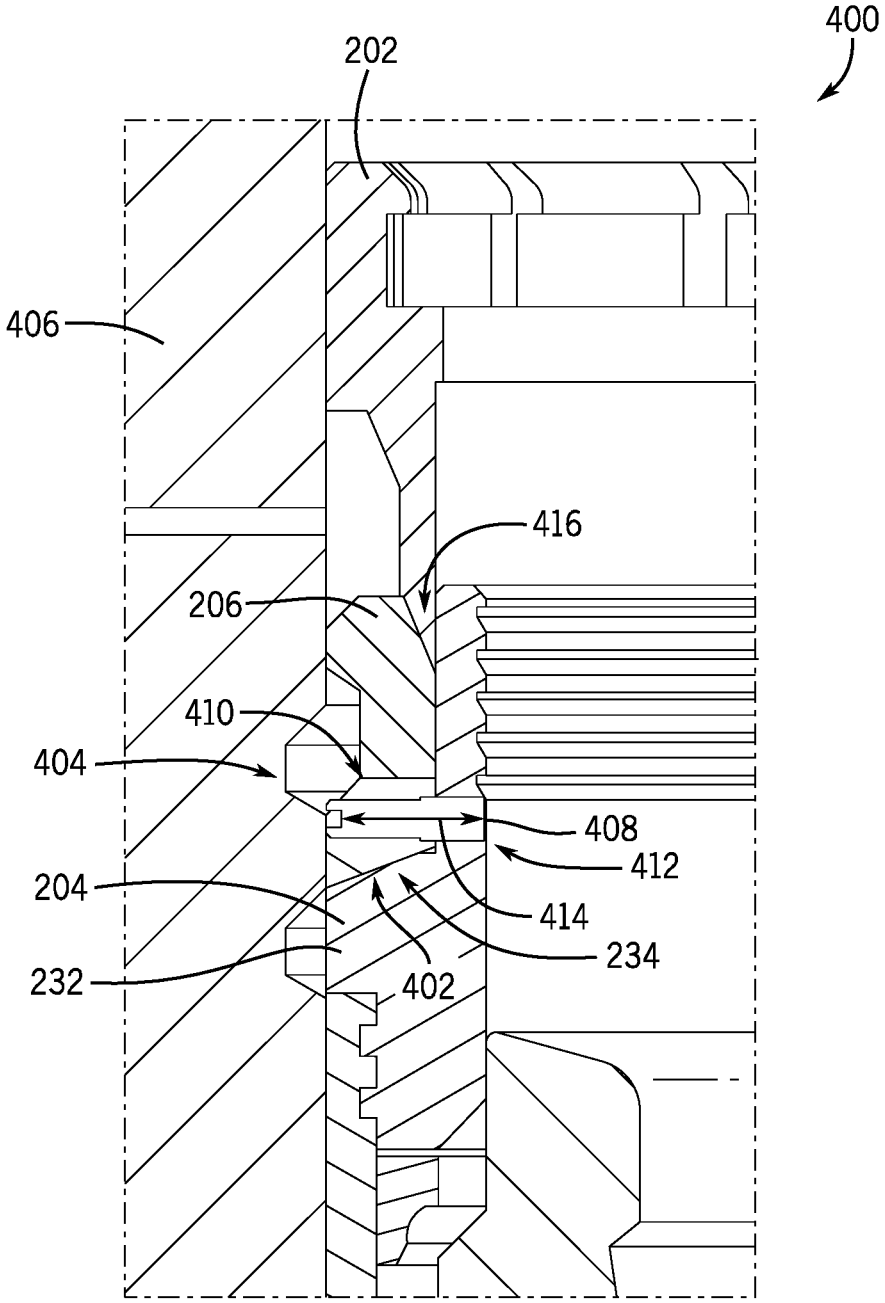
FIG. 4 is a detailed cross-sectional view of an embodiment of an anti-rotation configuration, in accordance with embodiments of the present disclosure.

FIG. 4 is a detailed cross sectional view of an embodiment of an anti-rotation configuration 400 that includes the hanger lock E-ring 202, the shoulder ring 204, and the hanger lock ring 206. In this example, the hanger lock ring 206 is arranged along the uphole side 234 of the shoulder 232. In one or more embodiment, an interface 402 between the hanger lock ring 206 and the uphole side 234 is particularly selected based, at least in part, on one or more expected operating conditions. In various embodiments, the angle of the interface 402 is selected to facilitate force transfer to drive the hanger lock ring 206 radially outward and into a mating profile 404 of a wellhead housing 406. That is, the hanger lock ring profile 214 (FIG. 2) may be driven outwardly to interact with the mating profile 404.

In this embodiment, the hanger lock ring 206 is secured to the shoulder ring 204 via a pin 408. The pin 408 extends through respective apertures 410, 412 formed through the hanger lock ring 206 and the shoulder ring 404. In at least one embodiment, the pin 408 is positioned approximately 180-degrees from the lock ring split opening. In at least one embodiment, a plurality of pins 408 are used, which may be in a stacked configuration. In one or more embodiments, more than one pin may be aligned or stacked, but in this configuration, only a single pin is shown. In operation, the pin 408 may prevent rotation or torsion of the hanger lock ring 206. For example, the pin 408 may block twisting during installation or during activation of the hanger lock E-ring 202. As will be described below, a position of one or more of the hanger lock ring 206 and/or the shoulder ring 204 along a length 414 of the pin 408 may change during different phases of installation and removal. That is, as the hanger lock ring 206 is driven radially outward toward the wellhead housing 406, the hanger lock ring 206 may slide along the length 414 of the pin.

In various embodiments, the hanger lock E-ring 202 may include one or more openings 416 positioned to align with the pin 408. For example, the hanger lock E-ring 202 may receive a force from an uphole location and be driven in an axially downward direction, which may, at least in part, facilitate radially outward movement of the hanger lock ring 206. Accordingly, one or more embodiments, a bottom end of the hanger lock E-ring 202 may move downward and toward the pin 408. To prevent the pin 408 from blocking or restricting movement, the one or more openings 416 may enable passage of the pin 408 without restricting the axial movement of the hanger lock E-ring 202. Furthermore, it should be appreciated that, in other embodiments, a length of the hanger lock E-ring 202 is particularly selected such that at full insertion of the hanger lock E-ring 202 the pin 408 is not contacted.

Figure 5A:
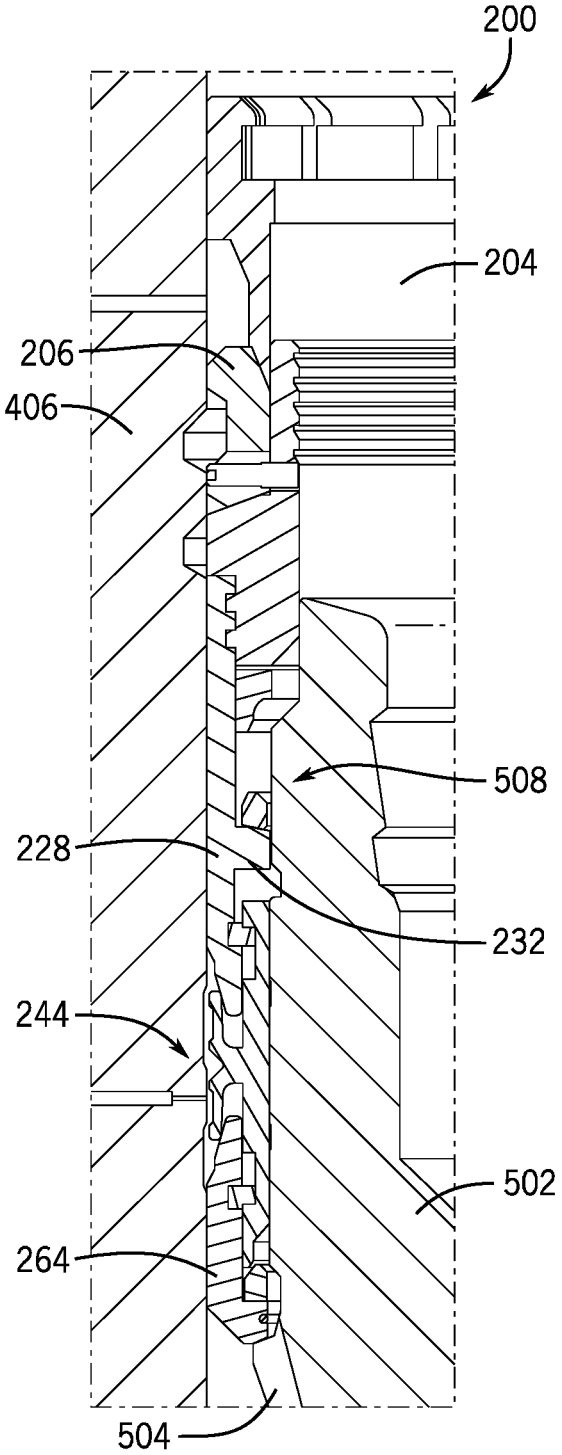
FIGS. 5A-5D are cross-sectional views of an embodiment of a setting sequence, in accordance with embodiments of the present disclosure.
Figure 5B:
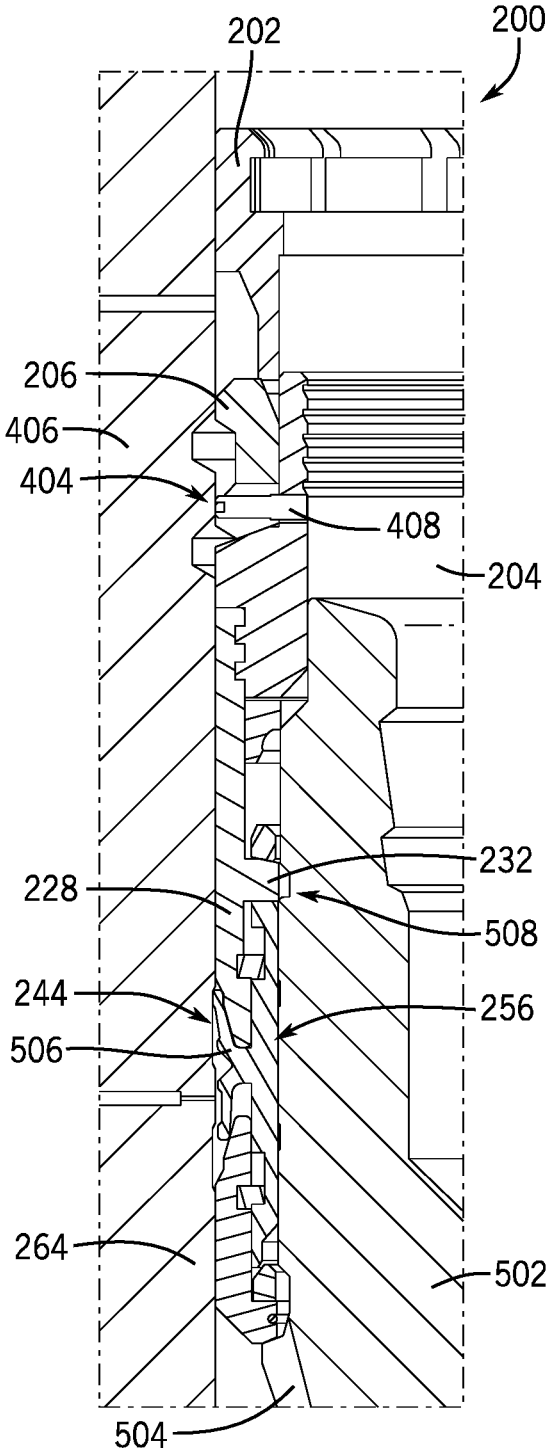
Figure 5C:
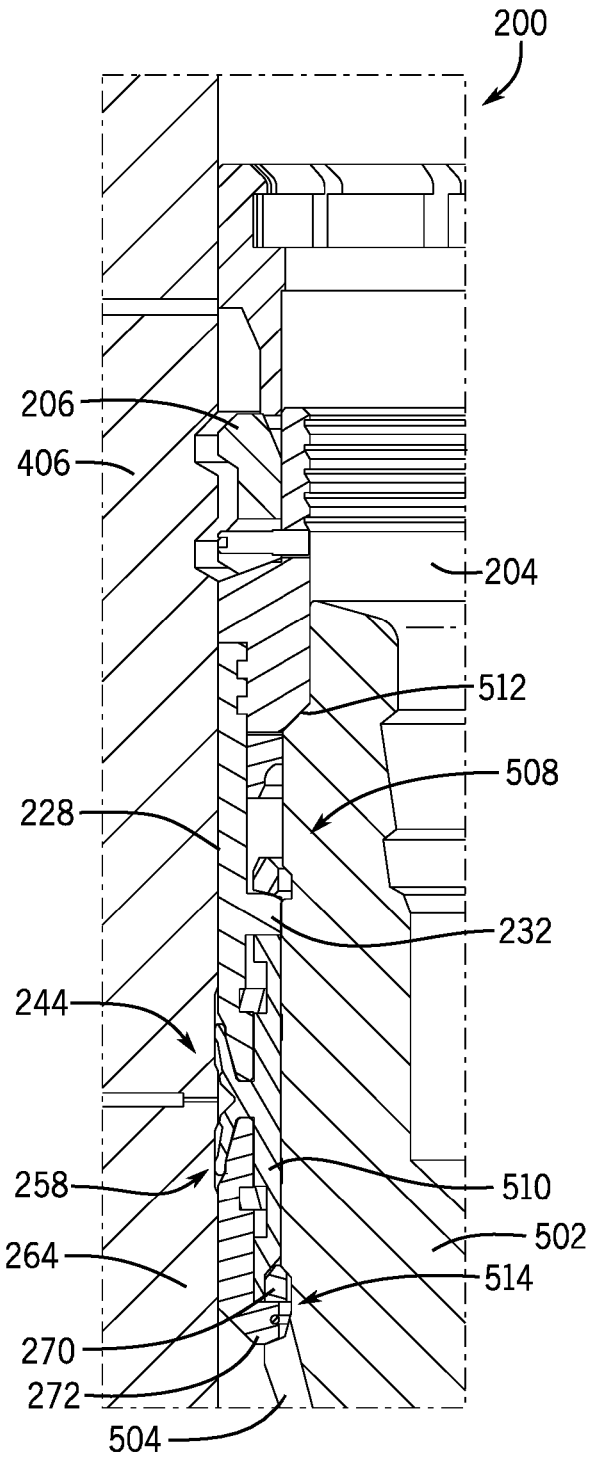
Figure 5D:
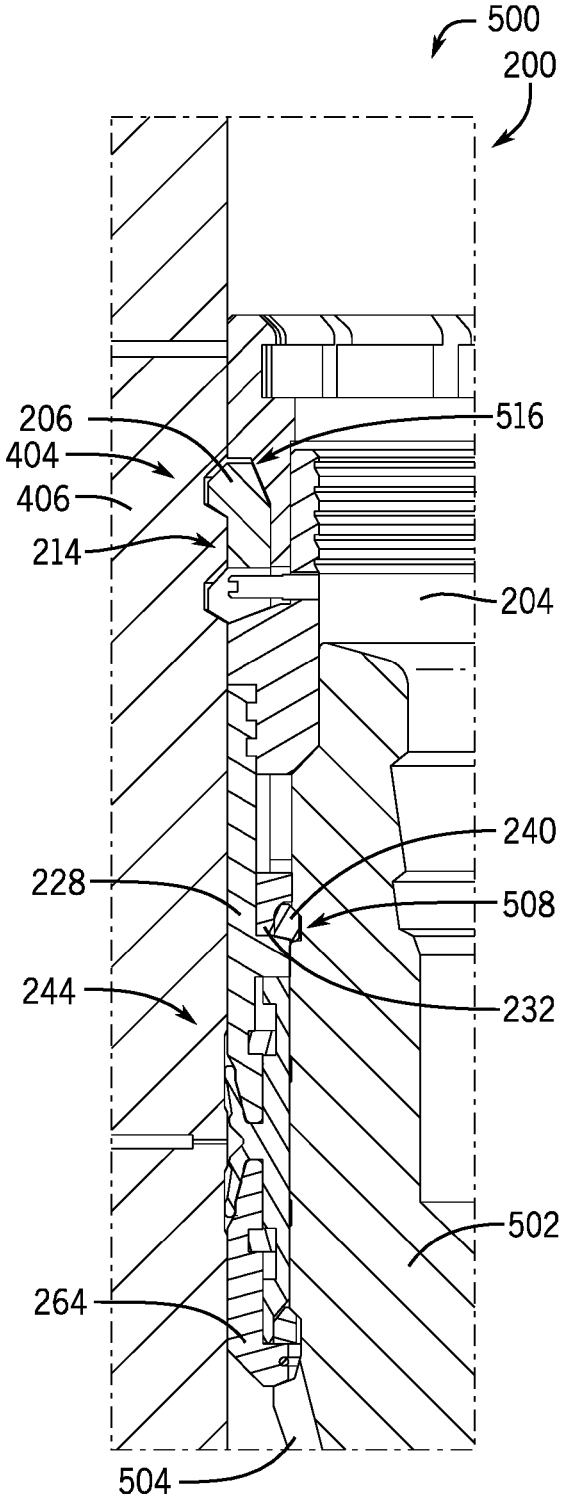

FIGS. 5A-5D are cross-sectional side views of embodiments of a seal setting sequence 500 in which FIG. 5A represents the seal landing on the hanger, FIG. 5B represents energizing the upper seal, FIG. 5C represents energizing the lower seal, and FIG. 5D represents energizing the lock rings, among other features. In this example, the seal assembly 200 is landed on a hanger 502. The illustrated hanger 502 includes a hanger shoulder 504 that receives the lower seal E-ring 264. As illustrated, this landing blocks further downward movement (e.g., movement into the wellbore) by the seal assembly 200. In various embodiments, one or more tools may be utilized to position and land the seal assembly 200, such as a running tool or the like.

The configuration of FIG. 5A illustrates the seal element 244 in a non-energized position, in that the seal element 244 has not been energized via the E-rings 228, 264. Furthermore, as shown in the illustrated embodiment, one or more components of the seal assembly are not aligned with or positioned to interact with a mating component, including at least the hanger lock ring 206 with respect to the wellbore housing 406. In various embodiments, components may be particularly selected and dimensioned to facilitate the landing position shown in FIG. 5A, such as the position of the shoulder ring 204 with respect to the hanger 502, and the like.

FIG. 5B illustrates energizing an upper seal 506 of the seal element 244 via the upper seal E-ring 228. In operation, a running tool may apply a force (e.g., an uphole force) in a downward direction at one or more of the hanger lock E-ring 202 and/or the shoulder ring 204, as shown by the arrow. The force may be translated through the shoulder ring 204 and directed toward the upper seal E-ring 228, which is driven into the upper opening 256, thereby expanding the upper seal 506.

When comparing the position of various components in FIGS. 5A and 5B, it can be seen that various features associated with the seal assembly 200 have moved axially downward. By way of example, the shoulder 232 of the upper seal E-ring 228 has transitioned to align with a groove 508 formed in the hanger 502. Furthermore, the hanger lock ring 206 is now closer to the mating profile 404 of the wellhead housing 406. As noted above, the connection via the pin 408 between the shoulder ring and the hanger lock ring 206 may, at least in part, facilitate the movement of the hanger lock ring 206.

FIG. 5C illustrates energizing a lower seal 510 of the seal element 244 via the lower seal E-ring 264. In this example, the downward force continues to be applied until both the lower seal 510 and the retainer ring 270 are engaged. In at least one embodiment, a positive stop at an upper hanger shoulder 512 (e.g., secondary shoulder) by the shoulder ring 204 will indicate the seal element 244 is fully engaged. That is, as shown in the transition between FIGS. 5A to 5C, downward movement of the shoulder ring 204 continues until the upper hanger shoulder 512 is contacted. In at least one embodiment, at least a portion of a lock down force is transferred from the casing hanger 502 to the hanger lock ring 206.

Further illustrated in FIG. 5C is the activation of the lower seal 510 via movement of the lower seal E-ring 264 into the lower opening 258. As noted above with respect to the upper seal 506, the lower seal E-ring 264 expands the outer leg of the lower seal 510, thereby setting the seal with the housing 406. In this example, the ID seal with the hanger 502 is set by a nominal interference between the seal element 244 and the hanger neck. The ID seal is energized by moving the seal element 244 down relative to the hanger 204. It should be appreciated that such sealing is present at both the upper and lower ID seals (e.g., seals associated with the upper seal 506 and the lower seal 510). In this example, the retainer ring 270 is positioned on the lower shoulder 272, and as a result of the movement of the seal element 244 (as shown by the different locations in FIGS. 5B and 5C), the retainer ring 270 is driven into a lower groove 514. The retainer ring 270 may maintain a position of the lower seal E-ring 264 during removal of the seal, as will be described below.

FIG. 5D illustrates energizing both the seal and hanger lock rings 240, 206. In this example, a second function of the tool provides a downward force that drives movement of the hanger lock E-ring 202 in a downward direction, which applies, at least in part, an outward radial force to the hanger lock ring 206 via a slanted interface 516 between the hanger lock ring 206 and the hanger lock E-ring 202. It should be appreciated that various embodiments may include separate tool functions for applying a force. Moreover, embodiments may further enable a continuous application of force. Accordingly, the hanger lock ring profile 214 may mate with the mating profile 404 of the wellhead housing 406. At substantially the same time, in various embodiments, the downward movement also drives the extensions 220 with the seal lock E-ring 222, which is applied to the seal lock ring 240, driving the seal lock ring 240 into the groove 508. Accordingly, the seal can be set and wellbore operations may take place.

Figure 6A:
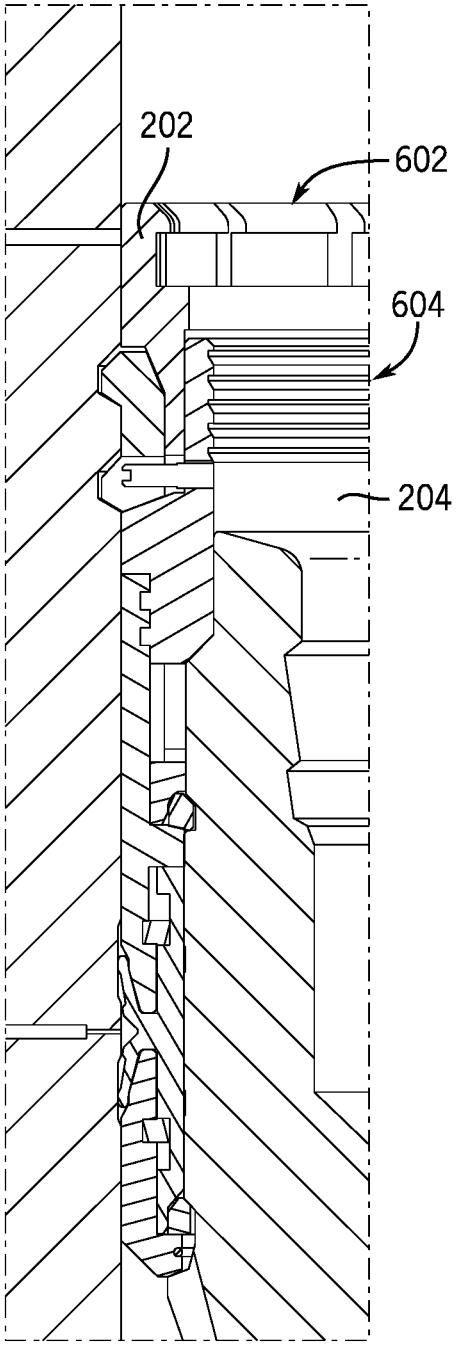
FIGS. 6A-6D are cross-sectional views of an embodiment of a retrieval sequence, in accordance with embodiments of the present disclosure.
Figure 6B:
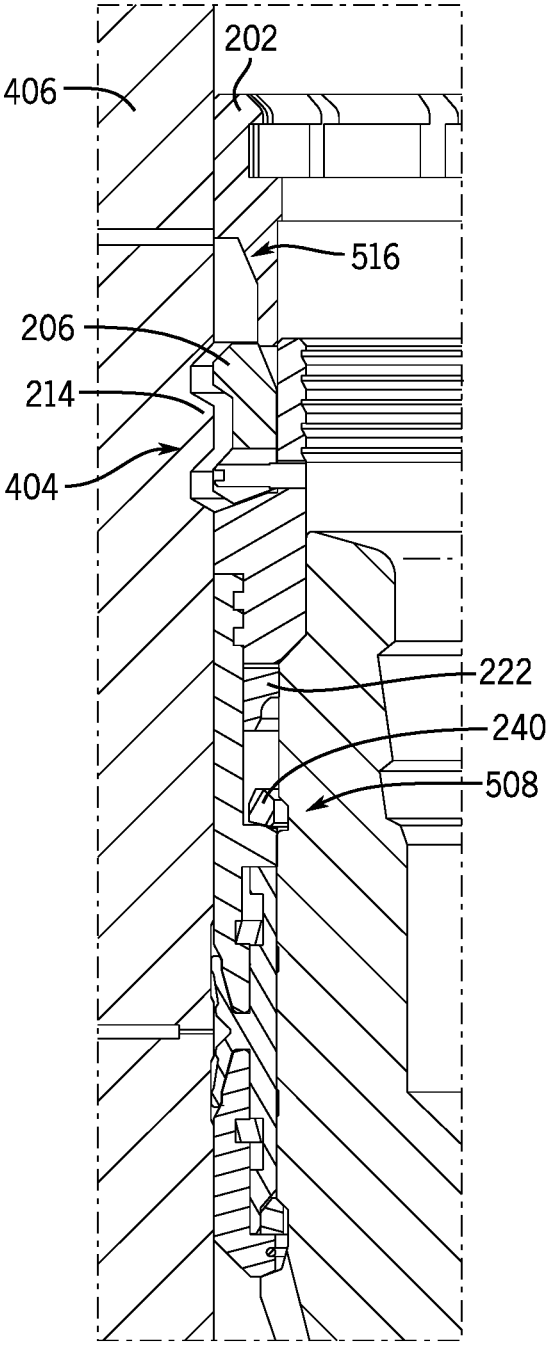
Figure 6C:
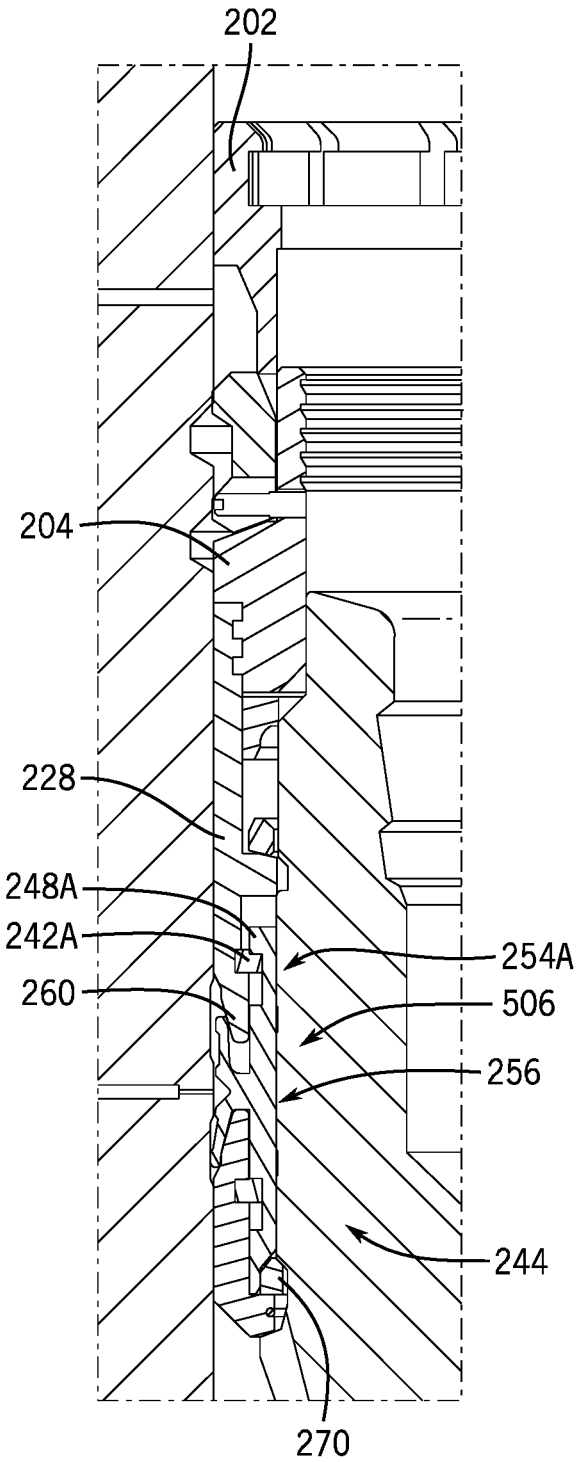
Figure 6D:
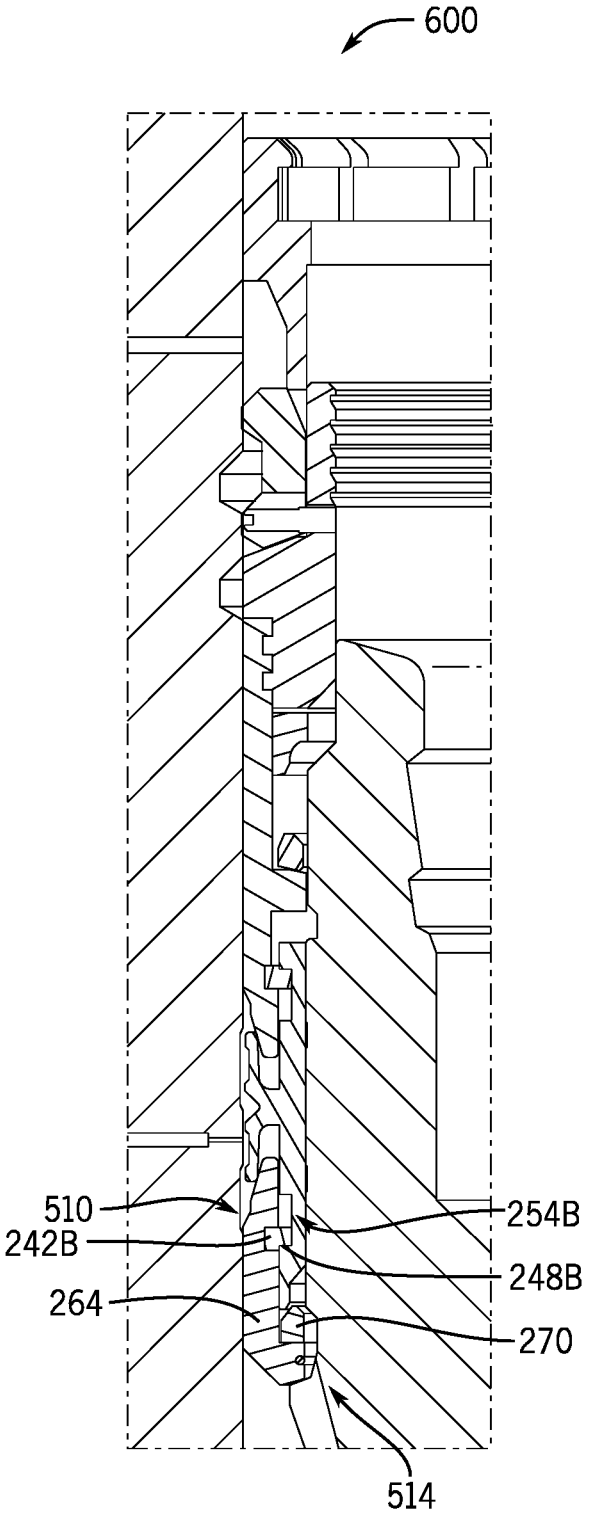

FIGS. 6A-6D are cross-sectional side views of embodiments of a seal retrieval sequence 600 in which FIG. 6A represents engagement of a retrieval tool, FIG. 6B represents deenergizing lock rings, FIG. 6C represents deenergizing an upper seal, and FIG. 6D represents deenergizing a lower seal and retainer ring, among other features. In this example one or more retrieval tools are engaged, for example along the hanger lock ring E-ring 202 and/or the shoulder ring 204 to apply an upward force (e.g., in an uphole direction) to retrieve the hanger lock E-ring 202, where may facilitate disengagement of the lock rings 206, 240. In at least one embodiment, the upward force applied to the shoulder ring 204 deenergizes the upper seal 506 by removing the upper seal E-ring 228, due to a connection to the shoulder ring 204. However, as shown, the lower seal 510 remains engaged due to the position of the retainer ring 270. Continued application of forces will deenergize the lower seal 510 and the retainer ring 270, thereby enabling retrieval in a single piece.

FIG. 6A illustrates the seal assembly 200 in a set position, such as the position from FIG. 5D. In this example, one or more features include respective retrieval interfaces 602, 604 such as the interface along the hanger lock E-ring 202 and the shoulder ring 204. The interface 602 may include one or more overhanging features or other engagement mechanisms that may enable a retrieval tool to engage the hanger lock E-ring 202. In contrast, the illustrated embodiment includes threads at the retrieval interface 604, but it should be appreciated that one or both of the interfaces 602, 604 may include threads. In operation, a tool may be tripped into the wellbore to engage the interface 602, 602 to facilitate removal.

FIG. 6B illustrates the hanger lock ring 206 being moved out of engagement with the wellhead housing 406, such that the profile 214 and the mating profile 404 are no longer engaged. As will be appreciated the upward movement of the hanger lock E-ring 202 removes the force at the slanted interface 516, thereby enabling the hanger lock ring 206 to move radially inward and away from the wellhead housing 406.

Furthermore, the upward movement of the hanger lock ring 206 also drives upward movement of the extensions 220, which are coupled to the seal lock E-ring 222. Accordingly, removal of the downward force also disengages the seal lock ring 240 such that the seal lock ring 240 transitions out of the groove 508.

FIG. 6C illustrates the upper seal 506 being deenergized due to the upward movement of the upper seal E-ring 228, which is coupled to the shoulder ring 204. As shown when looking at a position of the shoulder ring 204 in FIGS. 6B and 6C, the shoulder ring 204 in FIG. 6C is no longer seated on the hanger shoulder 504 and has been transitioned in an uphole direction. Accordingly, the end 260 is moved out of the opening 256. During this movement, the retainer segment 242A is also driven upward along the gap 254A to engage the overhang 248A. This engagement will apply an upward force to the seal element 244 to deenergize the lower seal 510, as shown in FIG. 6D. As shown, the retainer ring 270 keeps the lower seal E-ring 264 in place, thereby avoiding dragging the seal in the energized position. Instead, the upward force applied to the seal element 244 deenergizes the lower seal 510, which moves the retainer ring 270 out of the lower groove 514. Furthermore, the retainer segments 242B shown to transition along the gap 254B to engage the overhang 248B, which translates a force to the lower seal E-ring 264 and enables retrieval of the seal assembly 200.

Figure 7:
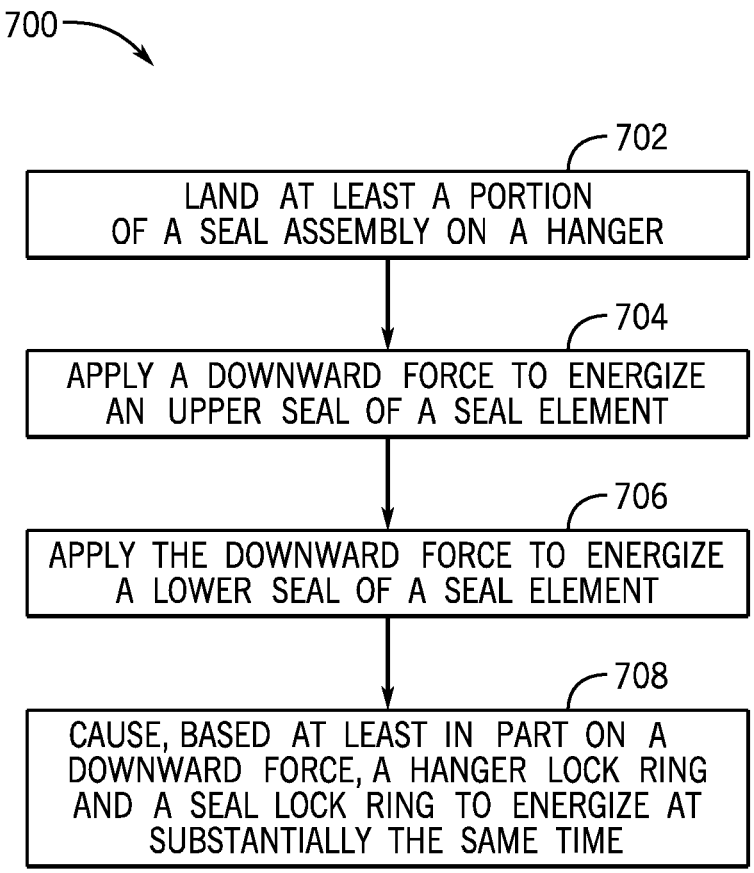
FIG. 7 is a flow chart of an embodiment of a method for setting a seal, in accordance with embodiments of the present disclosure.

FIG. 7 is a flow chart of an embodiment of a method 700 for setting a seal. It should be appreciated for this method, and all methods described herein, that there may be more or fewer steps. Moreover, the steps may be conducted in a different order, or in parallel, unless otherwise specifically stated. In this example, at least a portion of a seal assembly is landed on a hanger 702. By way of example, and as shown in at least FIG. 5A, one or more portions may be landed on a shoulder or stop point of a hanger. In at least one embodiment, a downward force (e.g., a first downward first associated with a first function of the tool) is applied to the seal assembly, such as to one or more E-rings 704. The downward force may be transmitted to one or more seal E-rings, which may energize an upper seal. Continued application of the downward force may also cause a lower seal to energize 706. In at least one embodiment, a downward force (e.g., a second downward force associated with a second function of the tool) may transition one or more lock rings into an energized position at substantially the same time 708.

Figure 8:
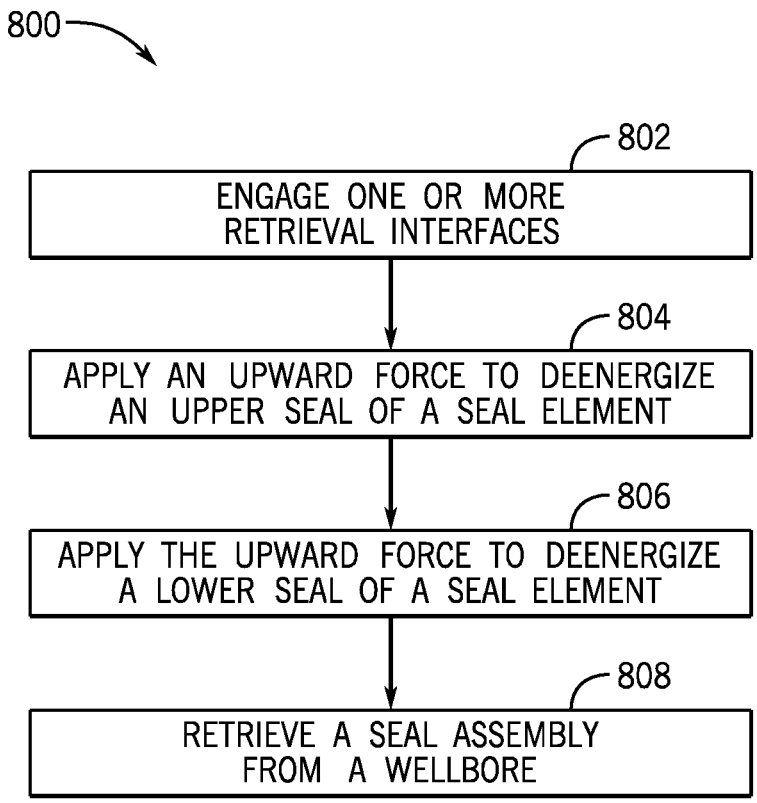
FIG. 8 is a flow chart of an embodiment of a method for retrieving a seal, in accordance with embodiments of the present disclosure.

FIG. 8 is a flow chart of an embodiment of a method 800 for disengaging and/or retrieving a seal. In this example, one or more retrieval interfaces are engaged 802, for example using a downhole tool that may engage locking features or mechanical fasteners. In at least one embodiment, an upward force (e.g., a first upward force associated with a first function of the tool) is applied to deenergize an upper seal 804, such as an upward force to transition an E-ring out of an opening in a seal element. In various embodiments, the upward force is further applied 806, which may deenergize a lower seal. In at least one embodiment, an upward force (e.g., a second upward force associated with a second function of the tool) may be applied to transition a retainer ring out of a groove or other locking features. As a result, the seal assembly may be retrieved from the wellbore 808.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A wellbore system, comprising:

a hanger lock energizing ring;

a hanger lock ring;

a shoulder ring, wherein the shoulder ring supports at least a portion of the hanger lock ring on a shoulder and the hanger lock energizing ring coupled to one or more extensions;

a seal energizing ring coupled to the shoulder ring, the seal energizing ring being positioned axially lower than the shoulder;

a seal element associated with the seal energizing ring, the seal element being driven into an energized position by the seal energizing ring;

a seal lock energizing ring arranged axially lower than the shoulder ring, the seal lock energizing ring being driven to move via the one or more extensions coupled to the seal lock energizing ring and the hanger lock energizing ring; and a seal lock ring positioned axially lower than the shoulder ring, the seal lock ring being supported, at least in part, by the seal energizing ring;

wherein both the hanger lock ring and the seal lock ring are set, substantially simultaneously, responsive to movement of the one or more extensions.

2. The wellbore system of claim 1, wherein the seal element is a multi-seal element further comprising:

a second seal energizing ring;

an upper seal having an upper opening to receive the seal energizing ring; and a lower seal having a lower opening to receive the second seal energizing ring.

3. The wellbore system of claim 1, wherein the one or more extensions are coupled to the hanger lock energizing ring and extend, at least in part, through at least one of the hanger lock ring and the shoulder ring.

4. The wellbore system of claim 1, further comprising:

a retainer segment associated with the seal energizing ring, the retainer segment extending radially inward to engage at least a portion of the seal element.

5. The wellbore system of claim 4, wherein the retainer segment axially moves across a gap responsive to a transition of at least a portion of the seal element between a deenergized position and the energized position.

6. The wellbore system of claim 1, further comprising:

a second seal energizing ring, the second seal energizing ring positioned opposite the seal energizing ring to extend in an axially uphole direction, wherein the second seal energizing ring moves into a lower opening of the seal element, opposite an upper opening associated with the seal energizing ring, to drive, at least in part, an outer diameter of the seal element against a housing and, at least in part, an inner diameter of the seal element against a hanger neck.

7. The wellbore system of claim 1, further comprising:

one or more pins extending through the hanger lock ring.

8. The wellbore system of claim 1, further comprising:

a casing hanger having an upper hanger shoulder downwardly sloped away from a wellbore axis, wherein at least a portion of a lock down force is transferred to the hanger lock ring from the casing hanger.

9. A method, comprising:

landing at least a portion of a seal assembly on a hanger;

applying a first uphole force to a shoulder ring, the shoulder ring transferring at least a portion of the first uphole force to an upper seal energizing ring to drive the upper seal energizing ring in a downhole direction;

energizing an upper seal of a seal element via the upper seal energizing ring;

energizing a lower seal of the seal element via a lower seal energizing ring; and applying a second uphole force to set a hanger lock energizing ring and a seal lock energizing ring.

10. The method of claim 9, wherein the hanger lock energizing ring and the seal lock energizing ring are set at substantially the same time.

11. The method of claim 9, wherein one or more extensions, associated with the shoulder ring transmit at least a portion of an uphole force to the seal lock energizing ring.

12. The method of claim 9, further comprising:

engaging one or more retrieval faces;

applying a retrieval force to the one or more retrieval faces, the retrieval force deenergizing a lock ring engaged with a wellhead housing.

13. The method of claim 12, further comprising:

deenergizing the upper seal of the seal element responsive to movement in an uphole direction of the upper seal energizing ring.

14. The method of claim 12, further comprising:

deenergizing the lower seal of the seal element responsive to movement in the uphole direction of the seal element, the seal element being engaged with one or more retainer segments associated with the upper seal energizing ring.

15. The method of claim 9, further comprising:

securing the hanger lock ring to the shoulder ring.

16. A seal assembly, comprising:

a seal element having an upper seal and a lower seal, the seal element being driven into an energized position via engagement of the upper seal and the lower seal by an upper seal energizing ring and a lower seal energizing ring;

a shoulder ring coupled to the upper seal energizing ring, the shoulder ring to transmit a downward force to at least the upper seal energizing ring to drive the upper seal energizing ring in a downward direction after at least a portion of the seal assembly is landed on a hanger;

a hanger lock ring positioned on a shoulder of the shoulder ring, the hanger lock ring being driven in a radially outward direction and into a wellhead housing responsive to movement in the downward direction by a hanger lock energizing ring; and a seal lock energizing ring coupled to the hanger lock energizing ring, the seal lock energizing ring being set simultaneously with the hanger lock ring.

17. The seal assembly of claim 16, wherein the hanger lock ring is associated with the shoulder ring.

18. The seal assembly of claim 16, further comprising:

one or more extensions coupling the seal lock ring to the hanger lock energizing ring, the one or more extensions positioned within to extend through a lock ring passage and a shoulder ring passage.

19. The seal assembly of claim 16, further comprising:

a plurality of first retainer segments associated with the upper seal energizing ring, the plurality of first retainer segments extending radially inward toward a first notch formed in the seal element, the plurality of first retainer segments arranged to move responsive to movement of the upper seal energizing ring; and a plurality of second retainer segments associated with the lower seal energizing ring, the plurality of second retainer segments extending radially inward toward a second notch formed in the seal element.

20. The seal assembly of claim 19, wherein the plurality of first retainer segments engage an overhang of the seal element responsive to movement in an upward direction, the plurality of first retainer segments to transmit a force applied to the upper seal energizing ring to deenergize the lower seal.

* * * * *